United States Patent [19]

Fairchild et al.

[11] Patent Number: 4,876,949

[45] Date of Patent: Oct. 31, 1989

[54] LOW TEMPERATURE AIR INDUCTION DIFFUSER

[75] Inventors: Paul W. Fairchild, Rogersville; Jim L. Claney, Springfield; William G. Fields, Branson, all of Mo.; Louis Bishop, Jr.; Mark W. Fly, both of Lowell, Ark.

[73] Assignee: Thermo-Aire Systems, Inc., Springfield, Mo.

[21] Appl. No.: 182,457

[22] Filed: Apr. 18, 1988

[51] Int. Cl.[4] ..... F24F 13/06

[52] U.S. Cl. ..... 98/40.1; 98/40.18

[58] Field of Search ..... 98/40.01, 40.02, 40.1, 98/40.11, 40.18, 40.19

[56] References Cited

U.S. PATENT DOCUMENTS

| | | | |
|---|---|---|---|
| 1,228,931 | 6/1917 | Kirk | 98/40.01 |
| 2,075,258 | 3/1937 | Anderson | 98/40.18 X |
| 2,437,741 | 3/1948 | Hoach | 98/97 |
| 2,528,130 | 10/1950 | Frisk et al. | 98/40.18 |
| 2,781,715 | 2/1957 | Labus | 98/40.18 X |
| 2,807,992 | 10/1957 | Ehman . | |
| 2,859,681 | 11/1958 | Rachlin | 98/40.11 |
| 3,308,741 | 3/1967 | Chambers | 98/40.11 |
| 3,492,761 | 2/1970 | Taylor | 47/17 |
| 3,537,380 | 11/1970 | Spradling | 98/40.11 |
| 4,407,187 | 10/1983 | Horney | 98/41.3 |
| 4,616,558 | 10/1986 | Ball et al. | 98/40.11 |
| 4,679,495 | 7/1987 | Locker | 98/40.01 X |

FOREIGN PATENT DOCUMENTS

| | | | |
|---|---|---|---|
| 2830363 | 1/1980 | Fed. Rep. of Germany | 98/40.18 |
| 56-157747 | 12/1981 | Japan | 98/40.18 |
| 161872 | 10/1979 | Netherlands | 98/40.11 |
| 4070 | 10/1978 | United Kingdom | 98/40.18 |

*Primary Examiner*—Harold Joyce

*Attorney, Agent, or Firm*—Fleit, Jacobson, Cohn, Price, Holman & Stern

[57] ABSTRACT

An air diffuser comprising a base and first, second, third and fourth side walls extending from the base to form a hollow shell. At least one of the side walls includes a plurality of bores therein forming multiple discharge tubes. The base and side walls form a plenum into which conditioned, pressurized air is supplied. The conditioned air is discharged from the plenum through the tubes in columns. Screws or other fastening devices may be used to secure the hollow shell to a surface. The multiple discharge tubes are each spaced from the surface and have longitudinal axes oriented in angular relation to the surface for entraining ambient air from above and below each column of air being discharged for mixing of ambient air with each column of the discharged conditioned air.

3 Claims, 1 Drawing Sheet

LOW TEMPERATURE AIR INDUCTION DIFFUSER

BACKGROUND OF THE INVENTION

This invention relates to an air diffuser designed to distribute air at varying flow rates which is lower in temperature than room temperature.

FIELD OF THE INVENTION

Various methods have been devised to distribute air at a lower temperature than standard temperature air in comfort cooling applications. Major problems with distributing lower temperature air include moisture condensation on components of the distribution device, high static pressure drops across the device, rapid fall of cool air from the device, causing uncomfortable and uneven temperatures in the space which is to be cooled, a low rate of air circulation causing stagnant air in the air-conditioned space, and high noise generation from the distributing device. Accordingly, a need exits for a device which can distribute air at a lower temperature than ambient air at varying flow rates to a space to provide a comfortable environment.

DESCRIPTION OF RELATED ART

U.S. Pat. No. 3,308,741 to Chambers discloses one known type of air diffuser apparatus. Diffuser 10 of the Chambers patent includes a V-shaped main diffuser panel including perforations therein. Within the main diffuser panel is located an intermediate perforated cross baffle plate.

U.S. Pat. No. 2,528,130 to Frisk et al discloses another type of device for blowing air into a room including cylindrical bodies which can be moved rotatably to change the direction of air flow.

SUMMARY OF THE INVENTION

The instant invention provides an improved degree of penetration by air discharged from one diffuser into a room in which the diffuser is located while simultaneously preventing condensation of moisture on exterior surfaces of the diffuser to a greater degree than has heretofore been possible.

One aspect of the invention is to discharge the lower temperature air through multiple tubular openings to form jets of air leaving the device. Each jet induces movement of a quantity of surrounding room air above, below and along the sides of each opening. The quantity of surrounding air in turn mixes with the lower temperature air to form a composite air stream of sufficiently higher temperature to provide comfort in the space below the device to increase the main velocity of air in the room to an acceptable level. The velocity of air in the surrounding room, as it is pulled across surfaces of the instant device and into the composite stream, is sufficient to absorb any excess condensation on the surfaces of the device. The wall thickness of the material forming the device also aids in keeping condensation to a minimum.

It is accordingly an object of this invention to provide an air diffuser comprising a base and first, second, third and fourth side walls extending from the base to form a hollow shell. At least one of the side walls includes a plurality of bores therein forming multiple discharge tubes. The base and side walls form a plenum into which conditioned, pressurized air is supplied. The conditioned air is discharged from the plenum through the tubes in columns. Screws or other fastening devices may be used to secure the hollow shell to a surface. The multiple discharge tubes are each spaced from the surface and have longitudinal axes oriented in angular relation to the surface for entraining ambient air from above and below each column of air being discharged for mixing of ambient air with each column of the discharged conditioned air.

DESCRIPTION OF THE PREFERRED EMBODIMENT

Figure 1:
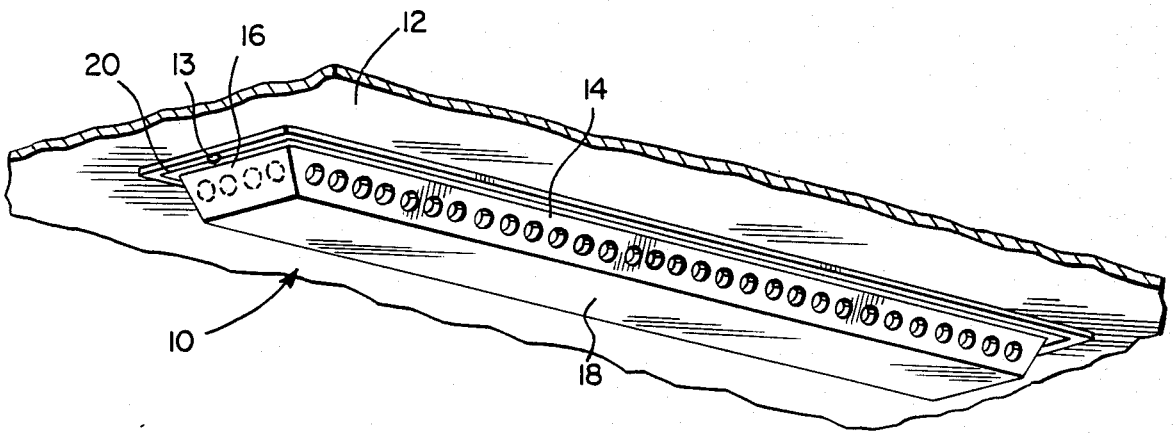
FIG. 1 is an isometric view of an air diffuser according to the instant invention.

Referring now to FIG. 1, an air diffuser according to the instant invention is shown and is generally designated by reference numeral 10.

An air diffuser 10 which is to be used to discharge cooled air at a temperature lower than room temperature is secured to a ceiling surface 12 in any conventional manner, such as by screw 13. The air diffuser includes a first pair of elongated side walls 14 and a second pair of elongated side walls 16 which, as illustrated, are shorter than the first pair of elongated walls. Each pair of elongated walls extends upwardly as shown from a base 18 which, in the illustrated embodiment, is flat and integrally formed with the first and second pairs of elongated walls.

Each wall 14 of the air diffuser diverges outwardly away from the other wall 14 as it extends upwardly from the base 18. Each wall 16 similarly diverges from the other wall 16 as it extends upwardly from the base.

Figure 2:
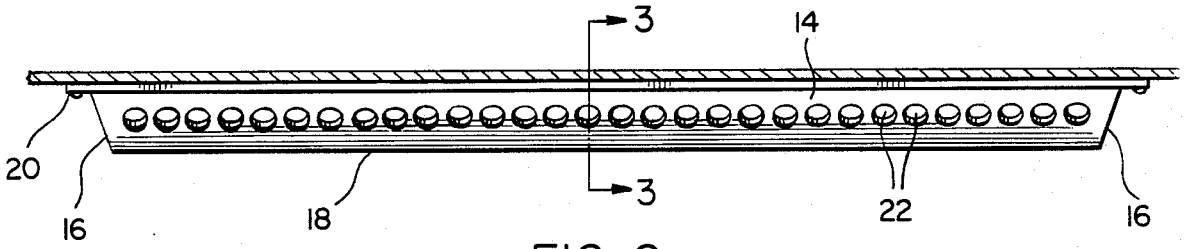
FIG. 2 is a side view of the air diffuser shown in FIG. 1.
Figure 3:
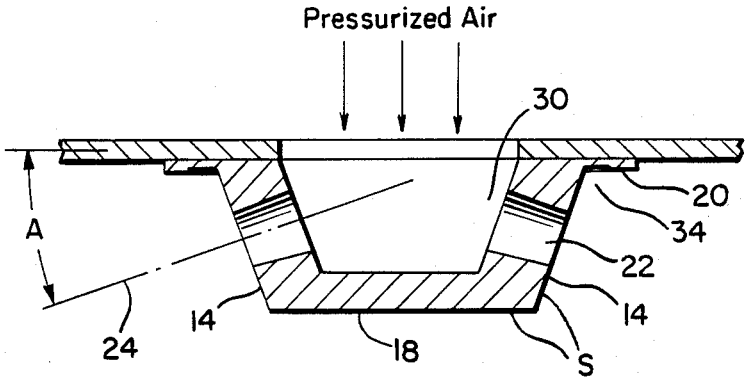
FIG. 3 is a sectional view of the device as seen along section line 3—3 at the center of the air diffuser.

As noted previously, walls 14 and 16 and base 18 are integrally formed with each other, as FIGS. 1–3 show. Upper edges of walls 14 and 16 have a flange 20 extending outwardly from the elongated side walls entirely around the air diffuser. Flange 20 is used for attaching the diffuser 10 to a ceiling or wall.

Multiple discharge tubes 22 are provided in at least one of the side walls 14 and 16. The discharge tubes 22 may also optionally be provided in two, three or in all four side walls 14 and 16, depending on where the air diffuser is to be located. Each discharged tube 22 may be slightly inwardly tapered as it passes from an inner surface of a wall 14 or 16 to an outer surface of the wall so as to form a truncated conical volume. Each discharge tube 22 has a longitudinal central axis 24 which, when the air diffuser is mounted on a ceiling 12, is preferably oriented at an acute angle A relative to the ceiling.

The air diffuser 10 may be formed of a stamped or cast metal or metal alloy such as aluminum, steel, etc. Alternatively, the diffuser may be formed of plastic, rubber or other molded material, if desired.

Referring now to FIG. 3, pressurized air which has been cooled is forced in a known manner into a plenum 30 formed by side walls 14, 16 and base 18 as illustrated. The pressurized air is discharged through each of the multiple openings 22 into a room at a high velocity. It is clear from FIG. 3 that because each central axis 24 is oriented at an acute angle relative to the ceiling, the openings or tubes 22 discharge the streams of pressurized air away from and in angular relation relative to ceiling surface 12. As noted above, each opening may be slightly tapered so as to have a smaller cross section at the exterior of a wall 14 or 16 than at the interior thereof. The opening therefore can act as a throttle, and a slightly higher pressure can be made to build up in plenum 30 than that which builds up when simple cylindrical bores are used. The velocity at which pressurized air exists from the tubular openings can therefore be made slightly higher, and the columns of air exiting from openings 22 can project further into the room to more evenly distribute the cooled air.

A low pressure area is caused by each air stream exiting from an opening 22 and is able to pull warm air, which has risen to ceiling 12 and which surrounds the exterior surface S of the air diffuser shell, along the surface so as to evaporate condensed moisture on the surface. Since the longitudinal axis of each discharge tube 22 is preferably oriented at an acute angle A relative to the ceiling 12 on which the diffuser 10 is mounted, warm air which has risen to the ceiling is more easily moved through the diffuser corner region 34 and over surface S than if each longitudinal axis were parallel to wall or ceiling 12. A composite stream of air, which is formed by a mixture of the cooled air stream exiting from an opening 22 and of the warm air near ceiling 12 surrounding the air diffuser shell, is thus more easily obtained.

It should be clear to those skilled in the art that a diffuser as described above is equally useful as a floor mounted device which is used to distribute heated air.

The foregoing is to be considered as illustrative only of the principles of the invention. Since numerous modifications and changes may be apparent to those skilled in the art, it is not desired to limit the invention to the exact construction and operation shown and described. All suitable modifications and equivalents which fall within the scope of the invention may be resorted to.

What is claimed is:

1. An air diffuser comprising:

a base;

first, second, third and fourth side walls extending from said base to form a hollow shell, a first pair of said side walls diverging from one another and a second pair of said side walls also diverging from one another as the side walls extend upwardly from said base, at least one of said side walls including a plurality of bores therein forming multiple discharge tubes, said multiple discharge tubes each having a longitudinal central axis disposed at an acute angle relative to a surface on which said hollow shell is secured;

said base and said side walls forming a plenum into which conditioned, pressurized air is supplied, the conditioned air being discharged from said plenum through said multiple discharge tubes in streams of air, a low pressure area caused by each air stream exiting from said multiple discharge tubes pulling air surrounding the exterior surface of said hollow shell along said surface to evaporate moisture on the surface;

means securing said hollow shell to said surface;

said multiple discharge tubes each being spaced from the surface and discharging said streams of air away from and in acute angular relation to the surface for entraining ambient air from both above and below each column of air being discharged along the exterior of said hollow shell for mixing of ambient air with each column of the discharged conditioned air.

2. An air diffuser as defined in claim 1 wherein each of said multiple discharge tubes is tapered so as to have a smaller cross section at an exterior surface of one of said walls than at an interior surface thereof.

3. An air diffuser as defined in claim 2 wherein a flange extends outwardly from said side walls, said shell being connected by said flange to said surface.

* * * * *